US011871848B1

(12) United States Patent
Wang

(10) Patent No.: US 11,871,848 B1
(45) Date of Patent: Jan. 16, 2024

(54) DEFLECTABLE FOLDING BRACKET

(71) Applicant: Shenzhen Chuangboyou Technology Development Co., LTD, Shenzhen (CN)

(72) Inventor: Lili Wang, Shenzhen (CN)

( * ) Notice: Subject to any disclaimer, the term of this patent is extended or adjusted under 35 U.S.C. 154(b) by 0 days.

(21) Appl. No.: 18/448,838

(22) Filed: Aug. 11, 2023

(30) Foreign Application Priority Data

Jul. 25, 2023 (CN) ..... 202310920592.8

(51) Int. Cl.
*A47C 4/28* (2006.01)
*A47C 1/032* (2006.01)
*A47C 7/14* (2006.01)

(52) U.S. Cl.
CPC ..... *A47C 1/03261* (2013.01); *A47C 4/28* (2013.01); *A47C 4/286* (2013.01); *A47C 7/14* (2013.01)

(58) Field of Classification Search
CPC ..... A47C 4/28; A47C 4/286; A47C 1/03261; A47C 7/14
USPC ..... 297/313, 314, 45
See application file for complete search history.

(56) References Cited

U.S. PATENT DOCUMENTS 4,890,886 A * 1/1990 Opsvik ..... A47C 7/448 297/313 X
7,547,067 B2 * 6/2009 Keilhauer ..... A47C 3/02 297/313
8,020,938 B2 * 9/2011 Glockl ..... A47C 7/004 297/313 X
9,854,914 B2 * 1/2018 Yoo ..... A47C 4/286
10,010,179 B1 * 7/2018 Stump ..... A47C 4/44
11,439,238 B1 * 9/2022 Wang ..... A47C 4/286
11,700,943 B1 * 7/2023 Wang ..... A47C 4/286 297/16.2
11,737,564 B2 * 8/2023 Chen ..... A47C 4/286 297/47
11,786,041 B1 * 10/2023 Chen ..... A47C 9/105 297/16.1
2002/0043846 A1 * 4/2002 Brauning ..... A47C 7/448 297/314
2012/0306249 A1 * 12/2012 Jung ..... A47C 3/026 297/313
2022/0386779 A1 * 12/2022 Garcia ..... A47C 4/286
2023/0023969 A1 * 1/2023 Zhu ..... A47C 4/286
2023/0172358 A1 * 6/2023 Xu ..... A47C 9/105 297/16.2
2023/0200539 A1 * 6/2023 Chen ..... A47C 3/18 297/47

* cited by examiner

*Primary Examiner* — Rodney B White

(57) ABSTRACT

A deflectable folding bracket according to the present invention includes a base and a plurality of supporting members movably connected to the base. The base includes an upper base and a lower base. The supporting members include three or more lower supporting members connected to the lower base and three or more upper supporting members connected to the upper base. The base further includes a deflection mechanism arranged between the upper base and the lower base, and the deflection mechanism includes an elastic member connected to the upper base and the lower base. In a case where the elastic member elastically deforms, the upper base deflects relative to the lower base. Since the deflection mechanism is arranged between the upper base and the lower base, the upper base can deflect relative to the lower base, which improves comfort and interest of portable furniture with the folding bracket.

7 Claims, 6 Drawing Sheets

DEFLECTABLE FOLDING BRACKET

CROSS-REFERENCE TO RELATED APPLICATIONS

The application claims priority to Chinese Patent Application No. CN202310920592.8, filed on Jul. 25, 2023, the contents of which are incorporated herein by reference.

TECHNICAL FIELD

The present invention relates to the technical field of leisure products, in particular to a deflectable folding bracket.

BACKGROUND

As the economy develops, urban people often choose to go out and enjoy outdoor life to relax.

When doing outdoor activities, such as fishing, camping, etc., people usually need portable furniture, such as tables, chairs, hammocks, etc. However, common portable furniture has limited functions and lacks comfort and interest when used.

SUMMARY

Based on this, it is desired to provide a deflectable folding bracket to solve the problem of limited use modes of portable furniture.

The present invention provides a deflectable folding bracket, including a base and a plurality of supporting members movably connected to the base, wherein the base includes an upper base and a lower base, the supporting members include three or more lower supporting members connected to the lower base and three or more upper supporting members connected to the upper base, a deflection mechanism is arranged between the upper base and the lower base, and the deflection mechanism includes an elastic member connected to the upper base and the lower base; in a case where the elastic member elastically deforms, the upper base deflects relative to the lower base.

Preferably, the elastic member is plate-shaped, and the deflection mechanism further includes a first stopper arranged on one side of the elastic member and a second stopper arranged on the other side of the elastic member, and the upper base is spaced apart from both the first stopper and the second stopper by a gap.

Preferably, the first stopper is higher than the second stopper.

Preferably, the second stopper includes an upright away from the elastic member, and the first stopper is higher than the upright.

Preferably, an upper surface of the upright is configured as an inclined plane.

Preferably, the deflection mechanism further includes a flexible protector at least surrounding the second stopper.

Preferably, an upper surface of the second stopper is configured as a cambered surface.

Preferably, the upper supporting members are pivotally connected to the upper base, and the lower supporting members are pivotally connected to the lower base.

A deflectable folding bracket according to the present invention includes a base and a plurality of supporting members movably connected to the base. The base includes an upper base and a lower base. The supporting members include three or more lower supporting members connected to the lower base and three or more upper supporting members connected to the upper base. The base further includes a deflection mechanism arranged between the upper base and the lower base, and the deflection mechanism includes an elastic member connected to the upper base and the lower base. In a case where the elastic member elastically deforms, the upper base deflects relative to the lower base. Since the deflection mechanism is arranged between the upper base and the lower base, the upper base can deflect relative to the lower base, which improves the comfort and interest of the portable furniture with the folding bracket.

BRIEF DESCRIPTION OF DRAWINGS

In order to more clearly illustrate the technical solutions in the specific embodiments of the present invention or in the prior art, drawings to be used for description of embodiments or the prior art will be briefly introduced below. Obviously, drawings referred to in the following description are some embodiments of the present invention, and those of ordinary skill in the art may also obtain other drawings based on these drawings without paying creative efforts.

DESCRIPTION OF EMBODIMENTS

Figure 1:
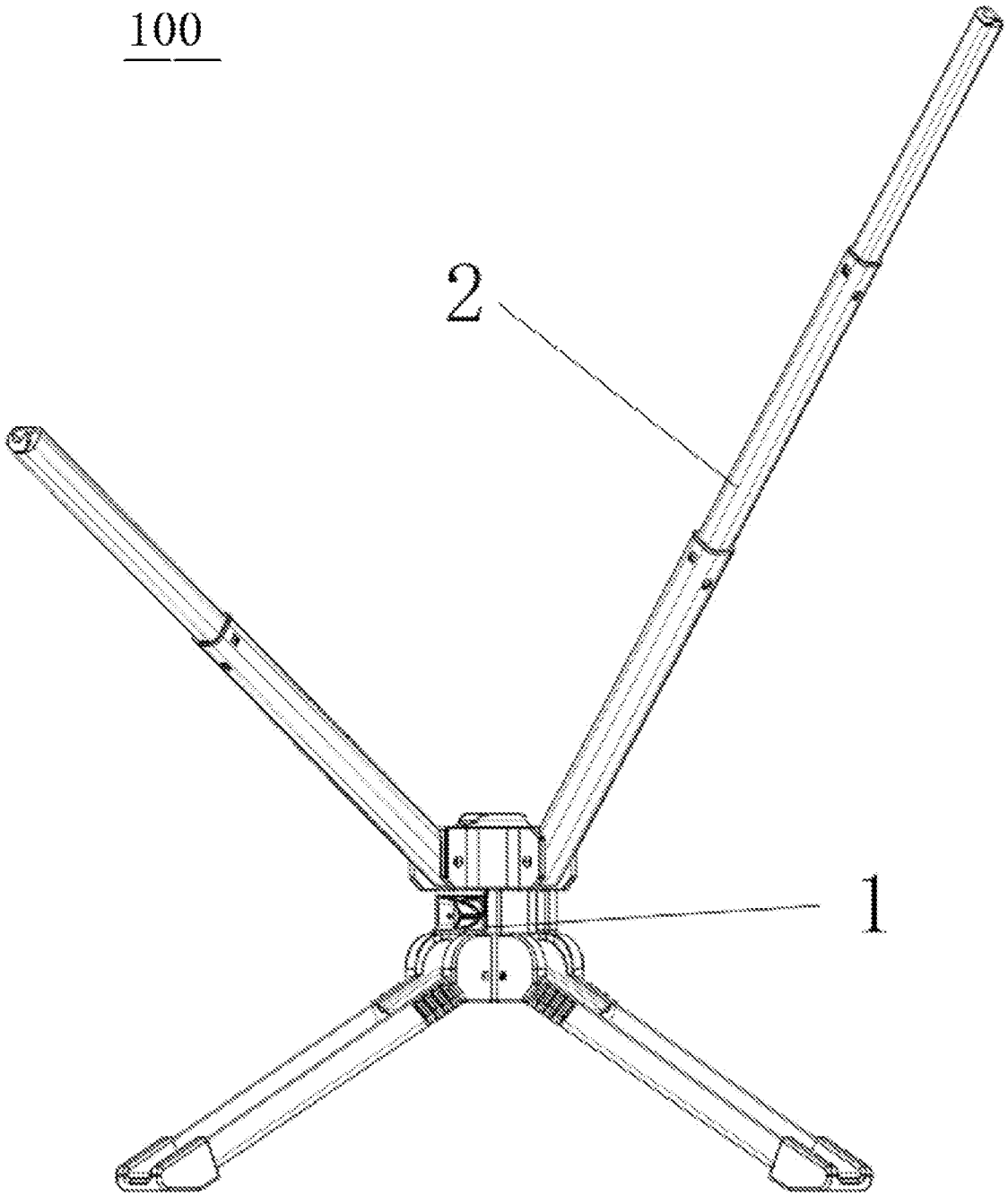
FIG. 1 is an assembled view of a deflectable folding bracket according to an embodiment.

The technical solutions in the invention will be described clearly and completely below in connection with the drawings, and it will be apparent that the embodiments described herein are merely a part of, not all the embodiments of the invention. All other embodiments obtained by a person of ordinary skill in the art based on the embodiments of the invention without creative efforts shall fall within the protection scope of the invention.

In the description of the present invention, it should be noted that the orientation or positional relationship indicated by the terms "center", "upper", "lower", "left", "right", "vertical", "horizontal", "inner", "outer", etc., is based on the orientation or positional relationship shown in the drawings. They are used only for the convenience of describing the present invention and simplifying the description, rather than indicating or implying that the indicated device or element must have a specific orientation, or must be constructed and operated in a particular orientation, so they are not to be construed as limitations of the invention. In addition, the terms "first", "second", "third" and the like are used herein for descriptive purposes only, and should not be construed as indicating or implying relative importance.

Figure 2:
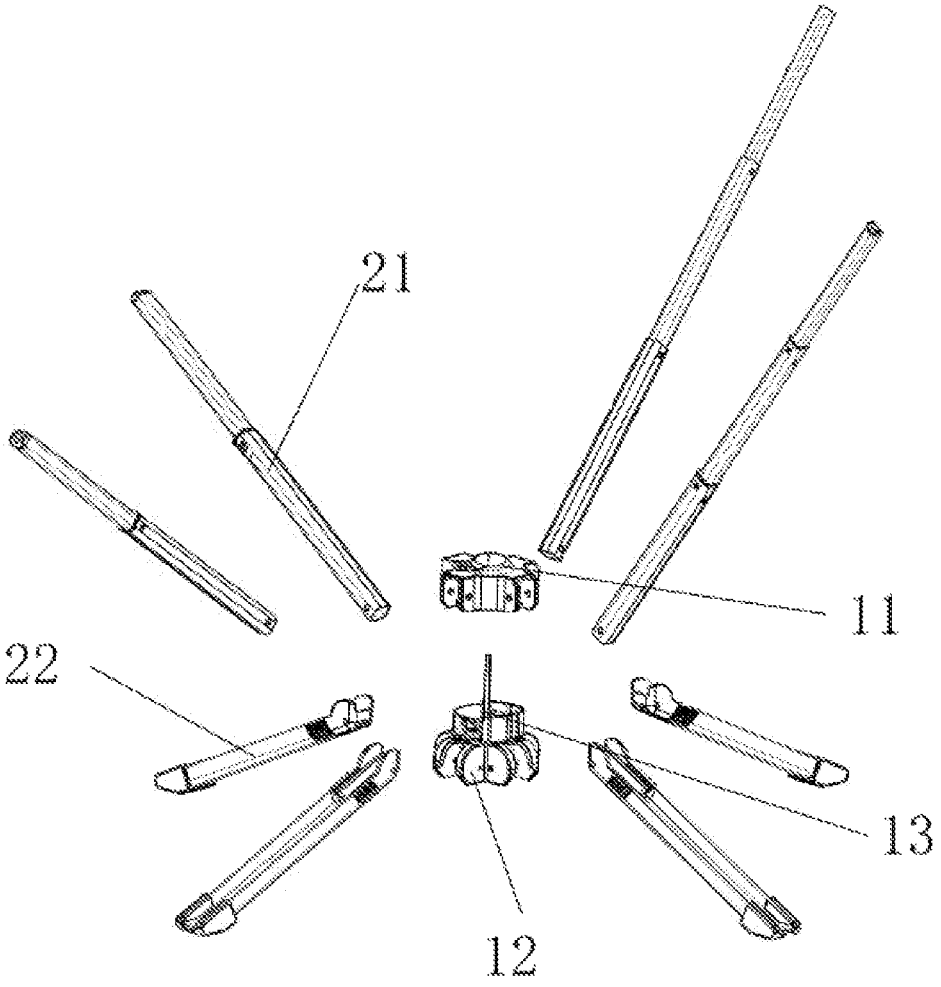
FIG. 2 is an exploded view of the deflectable folding bracket according to the embodiment.
Figure 3:
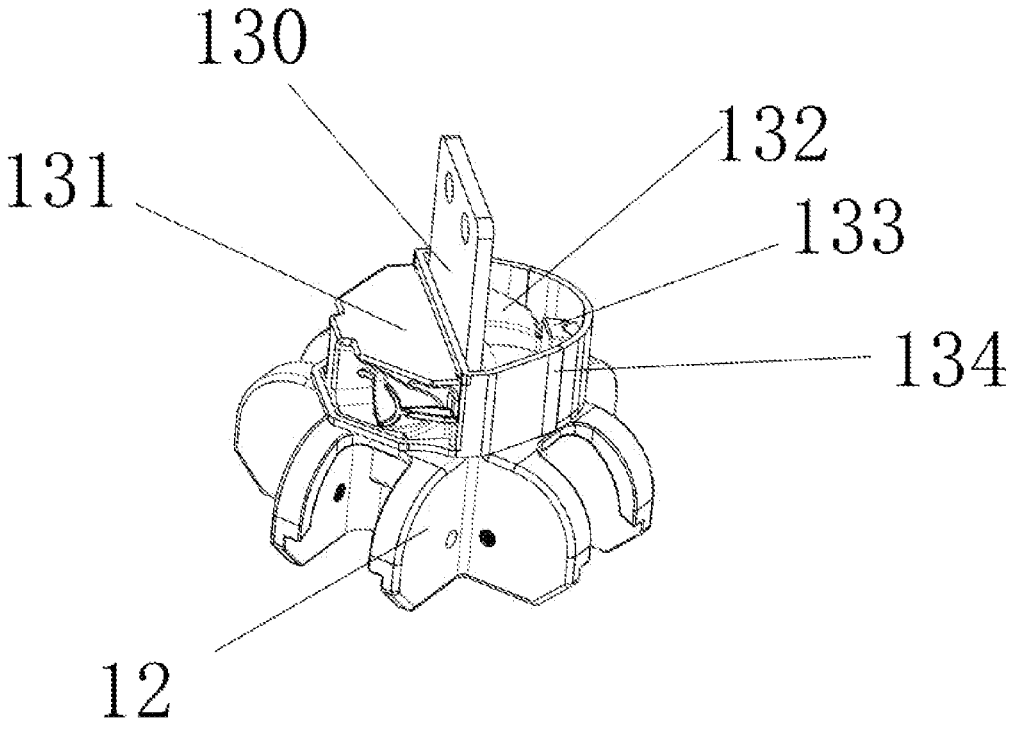
FIG. 3 is a schematic diagram of a deflection mechanism in the deflectable folding bracket according to the embodiment.

As shown in FIGS. 1-3, a deflectable folding bracket 100 according to the present invention includes a base 1 and a plurality of supporting members 2 movably connected to the base, the base 1 includes an upper base 11, a lower base 12, and a deflection mechanism 13 arranged between the upper base 11 and the lower base 12, and the support 2 includes three or more lower supporting members 22 connected to the lower base 12 and three or more upper supporting members 21 connected to the upper base 11. In this embodiment, the upper supporting members 21 are pivotally connected to the upper base 11, the lower supporting members 22 are pivotally connected to the lower base 12, and the upper supporting members 21 are configured as telescopic rods to reduce the size of the folding bracket 100 in a folded state. It can be understood that in other embodiments, the supporting members 2 can also be detachably connected to the base 1.

The deflection mechanism 13 includes an elastic member 130 connected to the upper base 11 and the lower base 12. In a case where the elastic member 130 elastically deforms, the upper base 11 deflects relative to the lower base 12, so that the folding bracket 100 produces a swinging effect, making portable furniture with the folding bracket 100, for example, a portable chair, more comfortable and more interesting.

Figure 4:
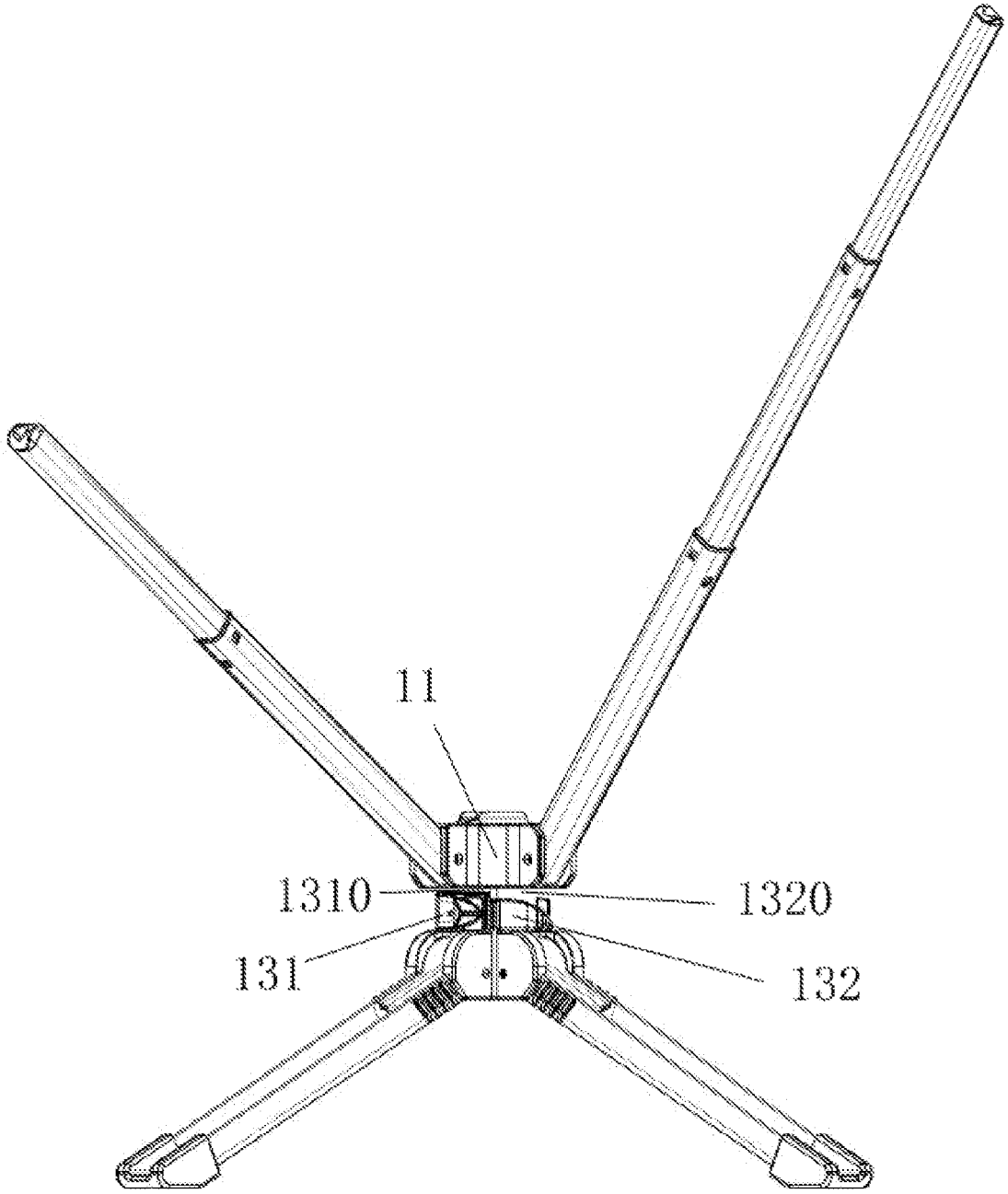
FIG. 4 is an assembled view of the deflectable folding bracket according to the embodiment without a protector.
Figure 5:
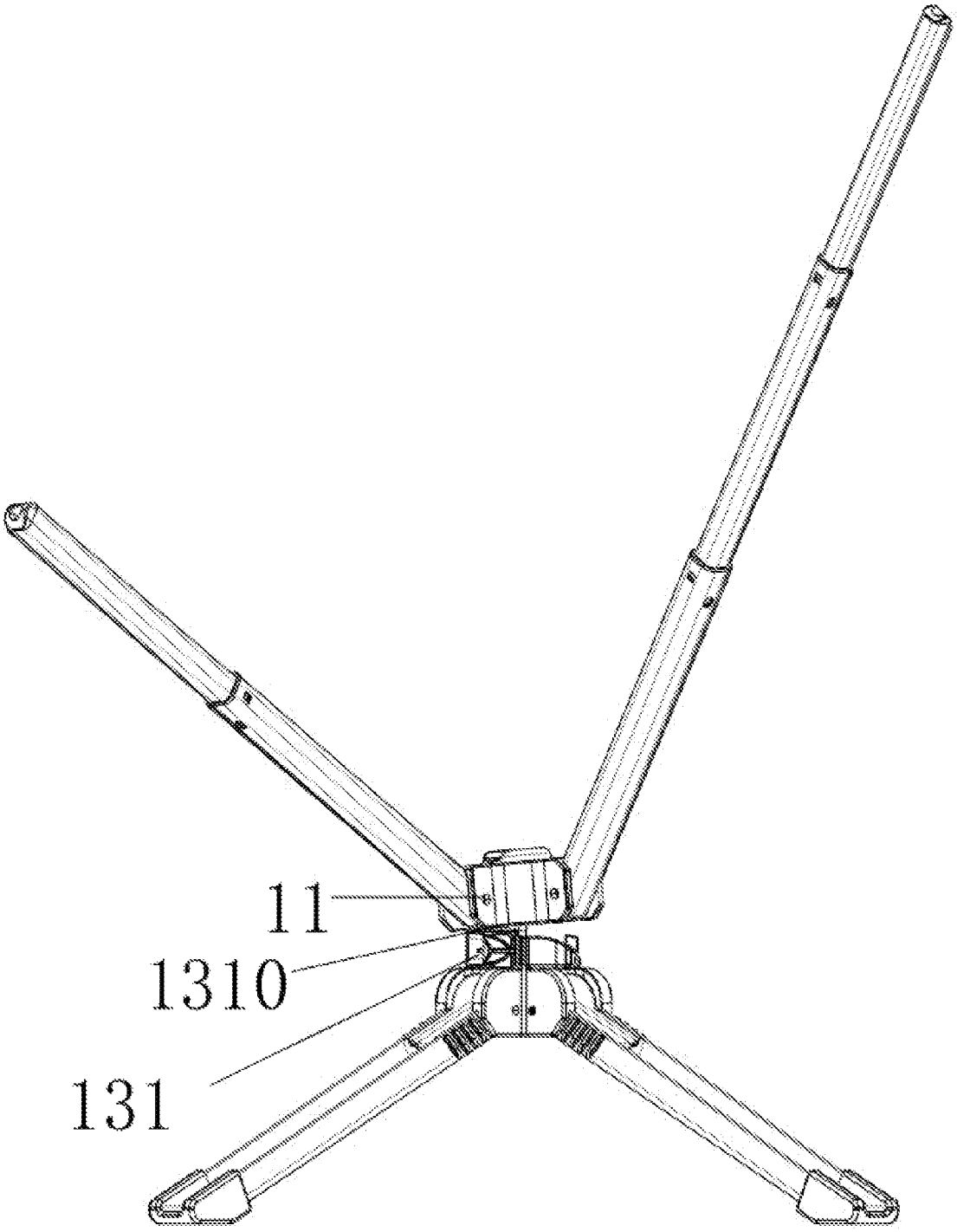
FIG. 5 illustrates a use state of the deflectable folding bracket shown in FIG. 4 deflecting to one side.

As shown in FIG. 4, in this embodiment, the elastic member 130 is configured as a plate-shaped metal member connected to the upper base 11 and the lower base 12, and the deflection mechanism 13 further includes a first stopper 131 arranged on one side of the elastic member 130 and a second stopper 132 arranged on the other side of the elastic member 130, there is a gap 1310 between a lower surface of the upper base 11 and an upper surface of the first stopper 131, and there is a gap 1320 between the lower surface of the upper base 11 and an upper surface of the second stopper 132. As shown in FIG. 5, in a case where the upper base 11 deflects toward the first stopper 131, the elastic member 130 bends toward the first stopper 131 until the lower surface of the upper base 11 abuts against the upper surface of the first stopper 131. It can be understood that the elastic member 130 used in the deflection mechanism 13 in this embodiment is configured as a plate-shaped metal structure having sufficient rigidity to support the upper base 11 and a weight carried by the upper base 11 and capable of elastically deforming. In other embodiments, the elastic member can also be configured as an elastic device of other shapes, such as a column shape, etc.

Preferably, the first stopper 131 is higher than the second stopper 132, and the upper surface of the second stopper 132 is configured as a cambered surface. That is, in a case where the upper base 11 deflects toward the second stopper 132, its deflection angle is larger than that when it deflects toward the first stopper 131.

Figure 6:
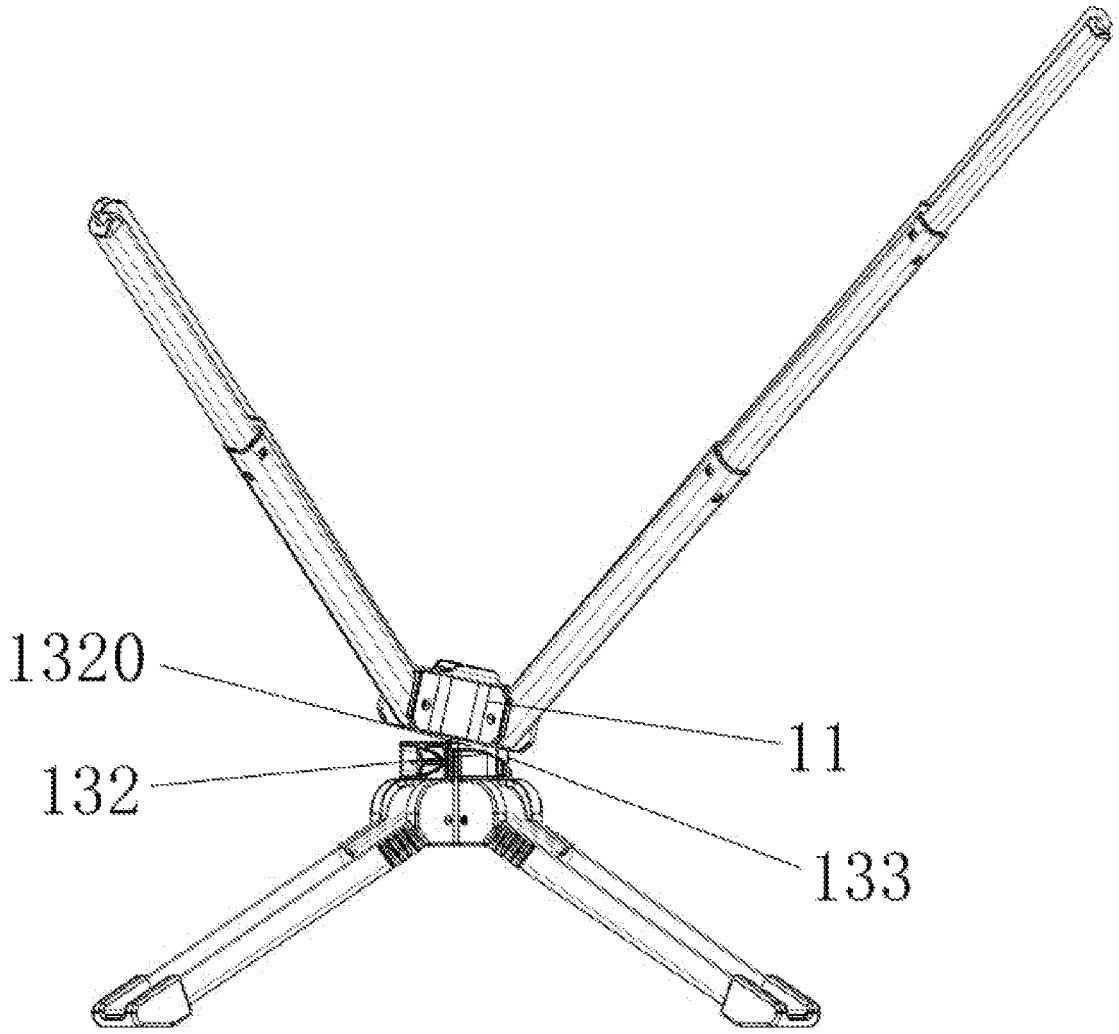
FIG. 6 illustrates a use state of the deflectable folding bracket shown in FIG. 4 deflecting to the other side.

In this embodiment, the second stopper 132 includes an upright 133 away from the elastic member 130, the first stopper 131 is higher than the upright 133, and an upper surface of the upright 133 is configured as an inclined plane. In this way, as shown in FIG. 6, in the case where the upper base 11 deflects toward the second stopper 132, the elastic member 130 bends toward the second stopper 131 until the lower surface of the upper base 11 abuts against the upper surface of the upright 133. The lower surface of the upper base 11 is attached to the upper surface of the upright 133, so that the folding bracket 100 stays stable and does not fall over in the case where the upper base 11 deflects toward the second stopper 132.

Preferably, the deflection mechanism 13 further includes a flexible protector 134 at least surrounding the second stopper 132, and the protector 134 can play a buffer role when the upper base 11 deflects but does not limit the deflection angle of the upper base 11, and also can protect a user's fingers from being pinched in use of the deflectable folding bracket 100.

A deflectable folding bracket according to the present invention includes a base and a plurality of supporting members movably connected to the base. The base includes an upper base and a lower base. The supporting members include three or more lower supporting members connected to the lower base and three or more upper supporting members connected to the upper base. The base further includes a deflection mechanism arranged between the upper base and the lower base, and the deflection mechanism includes an elastic member connected to the upper base and the lower base. In a case where the elastic member elastically deforms, the upper base deflects relative to the lower base. Since the deflection mechanism is arranged between the upper base and the lower base, the upper base can deflect relative to the lower base, which improves comfort and interest of the portable furniture with the folding bracket.

The above embodiments are only used for illustrating rather than limiting the technical solutions of the present invention. Although the present invention is described in detail with reference to the above embodiments, those of ordinary skill in the art should understand that they still can make modifications to the technical solutions disclosed in the above embodiments or make equivalent substitutions to some or all of technical features thereof, and these modifications or substitutions should not cause the essence of the corresponding technical solutions to depart from the scope of the technical solutions of the embodiments of the present invention.

What is claimed is:

1. A deflectable folding bracket, comprising:

a base, and a plurality of supporting members movably connected to the base, wherein the base comprises an upper base and a lower base, the supporting members comprise three or more lower supporting members connected to the lower base and three or more upper supporting members connected to the upper base, wherein the base further comprises a deflection mechanism arranged between the upper base and the lower base, the deflection mechanism comprises an elastic member connected to the upper base and the lower base, and in a case where the elastic member elastically deforms, the upper base deflects relative to the lower base;

wherein the elastic member is plate-shaped, and the deflection mechanism further comprises a first stopper arranged on one side of the elastic member and a second stopper arranged on the other side of the elastic member, and the upper base is spaced apart from both the first stopper and the second stopper by a gap.

2. The deflectable folding bracket according to claim 1, wherein the first stopper is higher than the second stopper.

3. The deflectable folding bracket according to claim 2, wherein the second stopper comprises an upright away from the elastic member, and the first stopper is higher than the upright.

4. The deflectable folding bracket according to claim 3, wherein an upper surface of the upright is configured as an inclined plane.

5. The deflectable folding bracket according to claim 1, wherein the deflection mechanism further comprises a flexible protector at least surrounding the second stopper.

6. The deflectable folding bracket according to claim 1, wherein an upper surface of the second stopper is configured as a cambered surface.

7. The deflectable folding bracket according to claim 1, wherein the upper supporting members are pivotally connected to the upper base, and the lower supporting members are pivotally connected to the lower base.

* * * * *